United States Patent [19]

Crow, III et al.

[11] Patent Number: 4,733,596

[45] Date of Patent: Mar. 29, 1988

[54] ADD-ON MISSILE CONTAINER FOR MILITARY VEHICLES

[75] Inventors: Robert A. Crow, III, Rochester; John Korpi, Livonia, both of Mich.

[73] Assignee: The United States of America as represented by the Secretary of the Army, Washington, D.C.

[21] Appl. No.: 8,999

[22] Filed: Jan. 30, 1987

[51] Int. Cl.[4] ..... F41F 9/04

[52] U.S. Cl. ..... 89/34; 89/1.804; 206/3

[58] Field of Search ..... 89/33.01, 34, 46, 1.805, 89/1.801, 1.802, 33.1, 36.13, 1.804; 206/3

[56] References Cited

U.S. PATENT DOCUMENTS

| | | | |
|---|---|---|---|
| 1,726,732 | 9/1929 | Doran | 206/3 |
| 3,316,808 | 5/1967 | Mais | 89/1.804 |
| 4,010,672 | 3/1977 | Kolbinger et al. | 89/1.802 |
| 4,141,277 | 2/1979 | Bouillon | 89/1.802 |
| 4,429,616 | 2/1984 | Grosser | 89/46 |
| 4,467,947 | 8/1984 | Minneman | 206/3 |

FOREIGN PATENT DOCUMENTS

| | | | |
|---|---|---|---|
| 3341875 | 5/1985 | Fed. Rep. of Germany | 89/1.802 |

*Primary Examiner*—Stephen C. Bentley
*Assistant Examiner*—Stephen M. Johnson
*Attorney, Agent, or Firm*—Peter A. Taucher; John E. McRae

[57] ABSTRACT

For use on a military vehicle a missile container wherein a pop-up rack structure is utilized to carry individual missiles. When the container cover is opened a linkage mechanism elevates the pop-up rack structure to present the missiles above the container, such that the soldier can readily remove the missiles from the rack structure and load same into a missile launcher located on the vehicle.

10 Claims, 8 Drawing Figures

ADD-ON MISSILE CONTAINER FOR MILITARY VEHICLES

GOVERNMENT INTEREST

The invention described herein may be manufactured, used, and licensed by or for the Government for governmental purposes within payment to me of any royalty thereon.

BACKGROUND AND SUMMARY OF INVENTION

This invention relates to a missile storage device (container) that can be added to a military vehicle to increase the number of missiles carried by the vehicle. The storage device preferably takes the form of an elongated container having sufficient internal capacity to store two or three missiles; the missiles are carried on pop-up rack structures that automatically bring the missiles out of the container when the container cover is opened.

In one scenario, two missile storage containers are mounted on exterior surfaces of a military vehicle outboard from a hatch opening. A soldier standing in the vehicle with his upper torso extending through the hatch opening is able to reach each container to remove a missile for loading into a missile launcher carried on the vehicle.

Preferably each container is formed of armor plate material resistant to enemy small arms fire. Each container has a hinged cover that can be swung upwardly to gain access to the missiles stored within the container. The covers weigh on the order of one hundred to three hundred pounds (depending on size and armor plate thickness). To enable the soldier to open the covers the cover hinges include spring devices operating as counterbalances for the cover weight. The aforementioned pop-up racks also have counterbalancing spring devices associated therewith to promote (facilitate) the desired pop-up action.

General objects of the invention are to provide add-on missile storage containers wherein:

1. the missiles are safely stored in positions protected from enemy small arms fire,
2. the missiles are made readily available when the container cover is opened,
3. the container cover has a counterbalance spring mechanism that can be adjusted to compensate for variations in the cover weight, and/or changes in spring force, and/or soldier preference,
4. missiles are positioned at approximately the same level as the missile launcher, whereby the soldier is not required to lift a missile to effect a missile load operation, and
5. missiles are located so that the soldier can load a missile into a launcher in a very short time period, to thus minimize the length of time that the soldier has potential exposure to enemy fire.
6. Missiles are located externally of the vehicle, thereby decreasing the possibility that an enemy hit on the missile storage device will hurt or kill the vehicle occupants.

THE DRAWINGS

FIGS. 1 THROUGH 3

Figure 1:
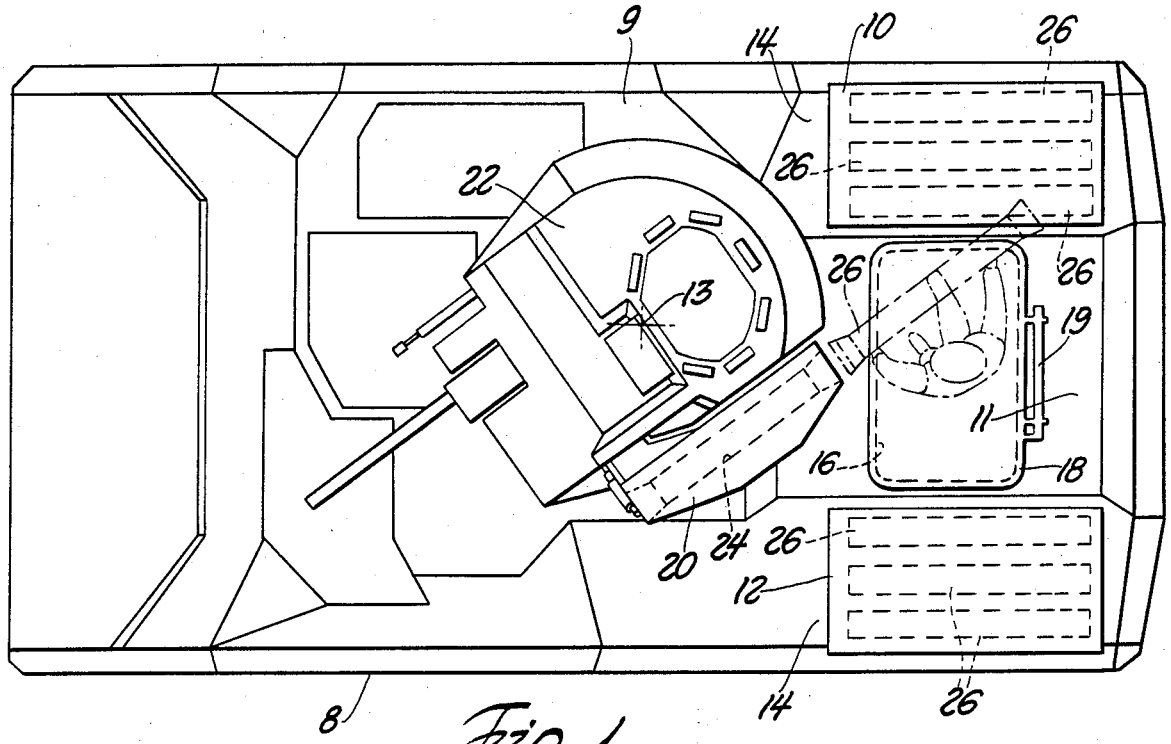
FIG. 1 is a top plan view of a conventional military vehicle having two missile containers thereon designed according to our invention.
Figure 2:
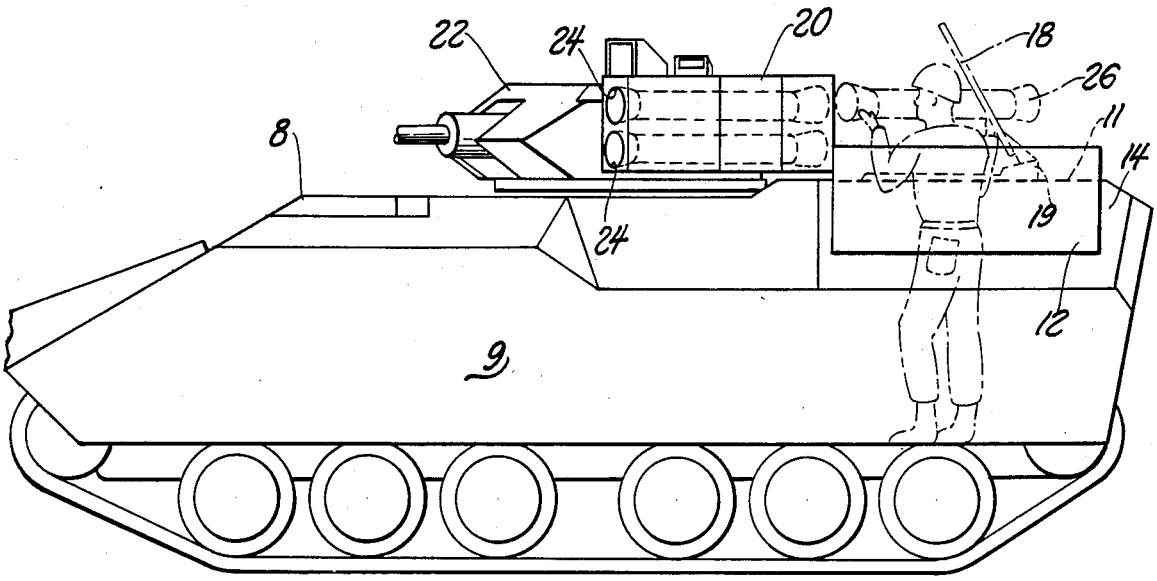
FIG. 2 is a side elevational view of the FIG. 1 vehicle.
Figure 3:
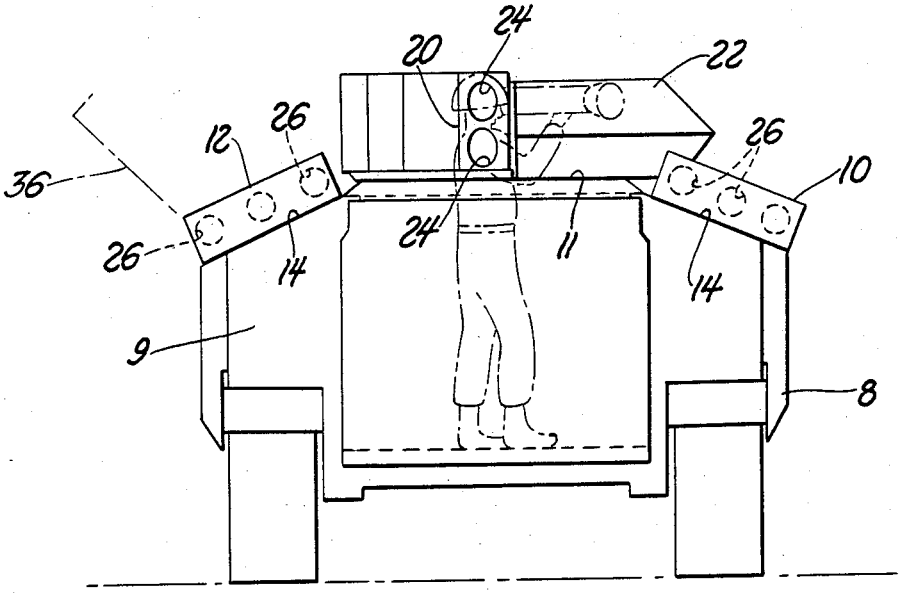
FIG. 3 is a rear end elevational view of the FIG. 1 vehicle.

FIGS. 1 through 3 illustrate a conventional military vehicle 8 having a known missile launcher 20 thereon. Two add-on missile containers 10 and 12 can be accommodated on the vehicle to increase the number of missiles available for firing by launcher 20.

Missile launcher 20 is in practice a conventional TOW missile launcher (meaning tube-launched, optically tracked, wire guided). Vehicle 8 may be a tracked military vehicle designated by the U.S. Army as the M-2 infantry fighting vehicle. The vehicle comprises a hull 9 having an upper horizontal surface area 11 located behind a rotary turret structure 22; the aforementioned missile launcher 20 is carried on the turret structure so that turret rotation around central axis 13 repositions the launcher into coincidence with selected enemy targets. An elevational drive mechanism in the turret adjusts the launcher in the elevational plane.

Missile launcher 20 includes two launch tubes 24 positioned one above the other. Each launch tube is designed to accommodate one missile. In the drawings a representative missile is designated by numeral 26. In practice, each missile is a cylindrical structure about four feet long, with a diameter on the order to six inches. Each missile weighs about sixty pounds.

The missile is loaded into the launch tube 24 by pushing it into the tube through the tube rear end. The missile must first be oriented (turned) around its axis so that guidance lugs on the missile side surfaces line up with guide channels in the launcher tube. After insertion of the missile into tube 24 a non-illustrated locking handle on the rear end of the tube is pushed upwardly to lock the missile in place in the tube. The missile is launched by an electrical signal controlled by manual switches on a panel structure in turret 22.

FIGS. 1 through 3 illustrate generally how the soldier accomplishes a missile-loading operation under pre-existing practice. The soldier stands upright within hull 8 with his upper torso extending through a hatch opening 16 formed in hull surface 11. During most periods the hatch opening is closed by a hatch cover 18 having a hinged connection 19 with hull surface 11. Prior to a missile-load operation cover 18 is raised to the upright position shown in FIG. 2. The cover partially protects the exposed soldier from enemy fire or detection from points behind the vehicle.

Under conventional practice, a number of missiles (for example ten missiles) are stored in racks within hull 8. One or more soldiers in the rear end of the hull remove a selected missile from the rack and lift it through hatch opening 16. The missile is then turned into a horizontal position, as shown in FIGS. 1 through 3, and pushed (shoved) into the launch tube.

Our invention contemplates the addition of two new missile containers 10 and 12 on sloping exterior surfaces 14 of hull 9. Each container is designed to store three missiles 26 outboard from hatch opening 16, such that a soldier standing in the vehicle can reach all missiles in each container. In an alternate (non-illustrated) embodiment of our invention each container is designed to store two missiles. The number of missiles in each container is primarily a function of the container size.

A soldier standing within hull 9 is able to remove an individual missile from the selected container, and load it into the launch tube in substantially the same fashion as previously described. The loading operation may however by somewhat quicker and easier since the soldier does not have to lift the missile through hatch opening 16. Each missile is relatively long, i.e., slightly longer than the width of hatch opening 16. Also, each missile is relatively heavy. Upward transfer of a missile through hatch opening 16 is an awkward operation that is best accomplished by two soldiers. On the other hand, a single soldier can easily remove a missile from a pop-up rack extending from container 10 or 12; the missiles are at the same level as the missile launcher tubes so that no lifting is involved in the missile-load operation.

The two new missile containers will permit missiles to be stowed externally, thereby minimizing danger to vehicle occupants in event of an enemy direct hit on the missile stowage system. Also, these external containers will permit somewhat faster missile-load operations, thereby reducing the time periods in which the soldier is exposed to potential enemy fire.

FIGS. 1 through 3 are intended to show the general locations of the new missile containers. but not the detailed construction of each container. FIGS. 4 through 7 illustrate the detailed features.

FIGS. 4 THROUGH 7

Figure 6:
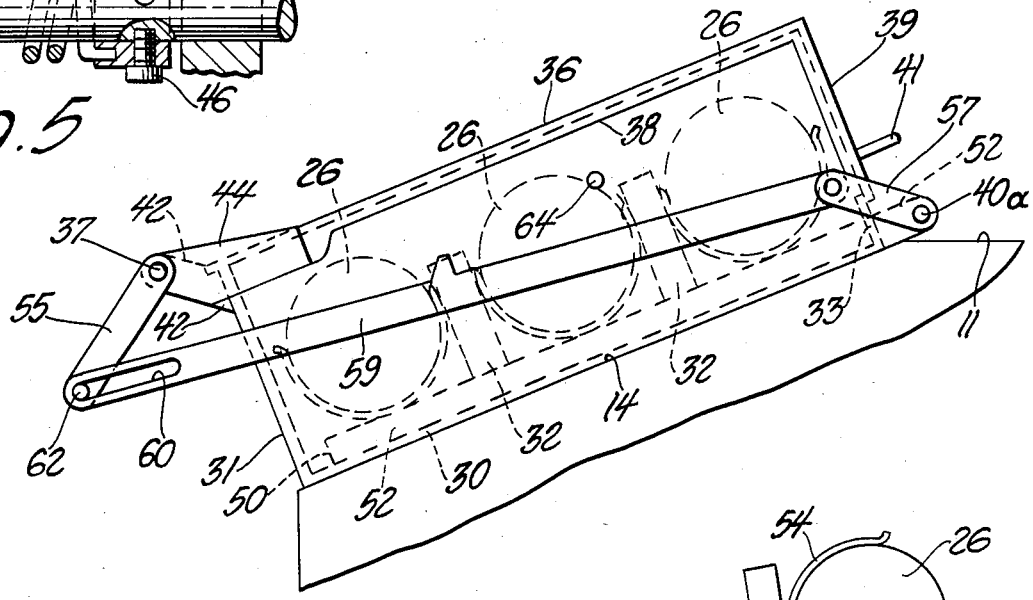
FIG. 6 is an end elevational view of the FIG. 4 missile container.
Figure 7:
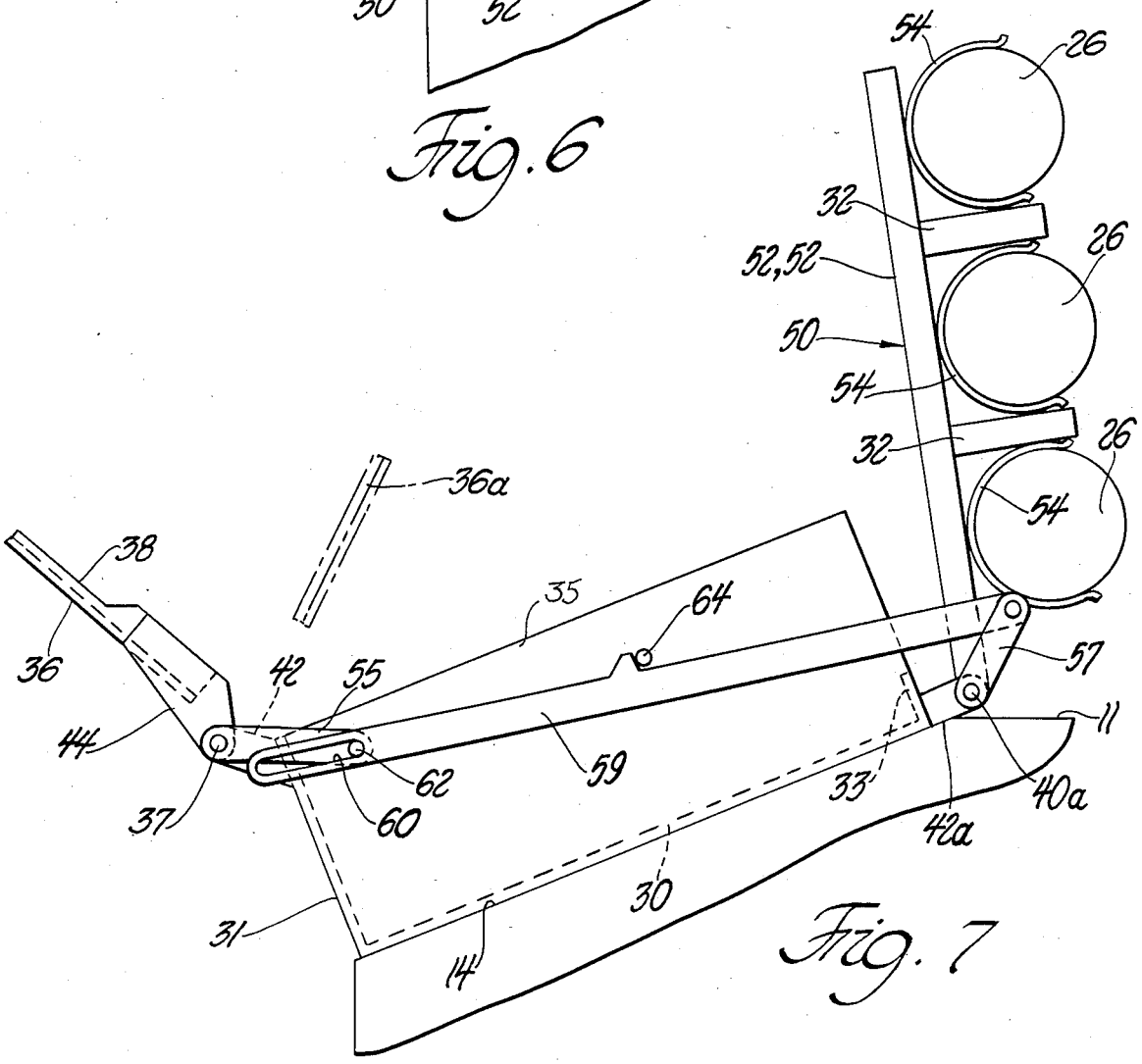
FIG. 7 is a view similar to FIG. 6, with the container cover in an open position.

As seen in FIGS. 6 and 7, a representative missile container comprises a bottom wall (plate) 30 positioned on hull surface 14. Any suitable means may be used to secure wall 30 to mounting surface 14. The container may be accommodated on the hull as an add-on device to pre-existing vehicles.

The container includes an outboard wall 31, inboard wall 33, and two end walls 35 extending upwardly from bottom wall 30. Disposed within the container is a rack structure 50, comprised of two bars 52 and two upstanding partitions (antifratracide barriers) 32. The partitions subdivide the container space into three compartments; each compartment accommodates one missile 26.

A cover 36 normally closes the container to protect the stored missiles from the elements (rain, snow, etc.) and enemy small arms fire. The cover preferably has flanges 38 at its ends to prevent entry of rain into the container. At its inboard edge the cover has a downwardly extending wall 39. Wall 39 extends to a point just below the upper edge of container wall 33 to provide a weather-sealed joint. The cover is normally retained in its closed position (FIG. 6) by a non-illustrated lock structure carried on wall 39. A handle 41 is affixed to wall 39 for manual manipulation of the cover between its open and closed positions.

Cover 36 is hingedly connected to the container for swinging motion around hinge axis 37. The necessary hinge structure comprises two axially-aligned shafts 40,40 rotatably mounted in arms 42 that extend from container wall 31. Bracket arms 44 connect each shaft 40 to cover 36, whereby the cover-shaft assembly can rotate (swing) as a unit around axis 37.

Figure 4:
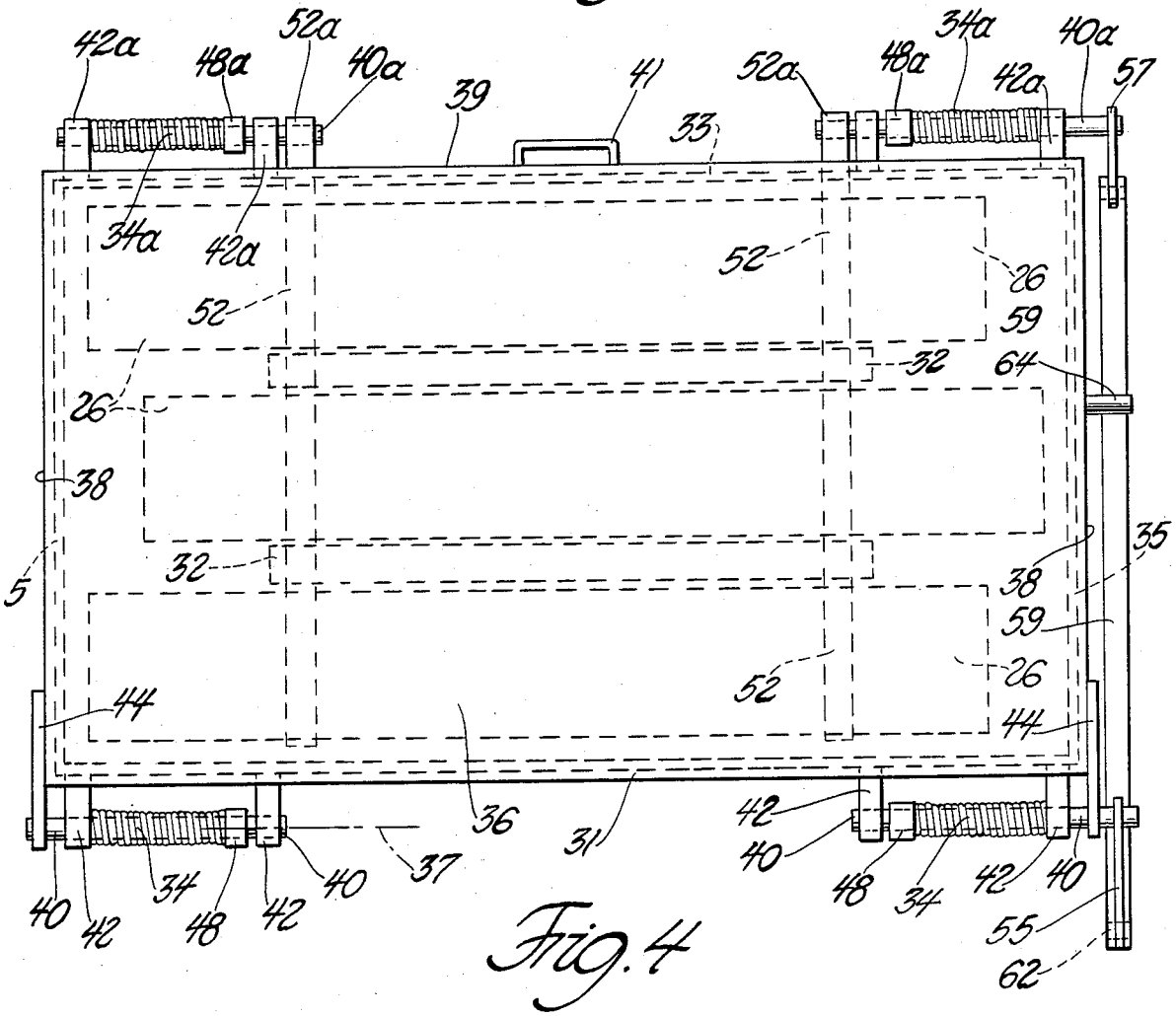
FIG. 4 is a top plan view of a missile container embodying our invention.
Figure 5:
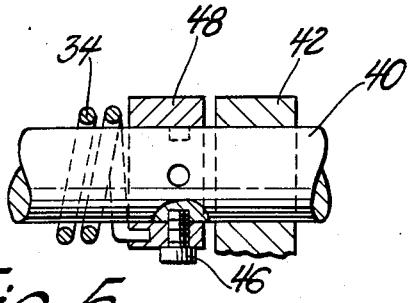
FIG. 5 is a fragmentary view of a structural detail used in the FIG. 4 missile container.

Cover 36 is counterbalanced to the open position (FIG. 7) by means of two torsion springs 34 (FIGS. 4 and 5). Each spring 34 has one of its ends anchored to an arm 42. The other end of each spring is anchored to a collar 48 that is adjustably carried on shaft 40. As best seen in FIG. 5, the adjustable connection comprises a set screw 46 threaded through a tapped opening in the collar into a blind hole in the shaft. By backing out the screw from the blind hole and rotating the collar it is possible to wind or unwind the torsion spring 34, thereby adjusting the spring pre-load force. In normal service screw 46 is screwed into the hole in the shaft to secure the collar and shaft together. During service the two springs 34,34 counterbalance cover 36 to its open position. The cover may be closed by a manual pull on handle 41.

The stored missiles 26 are carried on a rack structure 50 that comprises two elongated bars 52, partitions (antifratracide barriers) 32 and clips 54. In the closed position of cover 36 the rack structure is disposed in a prone position within the container. In the open position of cover 36 the rack structure is in a "pop-up" position (FIG. 7) wherein the missiles 26 are readily accessible to a soldier standing within the vehicle (as in FIG. 3).

Rack structure 50 has hinged connections with container wall 33 that are similar to the spring hinge structures used to mount cover 36. In FIG. 4, similar reference numerals (with suffixes a) are employed to designate similar components of the respective spring hinge structures. The spring hinge mechanism for rack structure 50 is wound so that the springs 34 counterbalance rack structure 50 (and the supported missiles) to the open "pop-up" position of FIG. 7.

Cover 36 and rack structure 50 are linked together so that when the cover is opened the rack structure will automatically pop up to its exposed position (FIG. 7). The linkage between the cover and rack structure comprises an arm 55 secured to a shaft 40, an arm 57 secured to shaft **40*a*, and an elongated link 59 trained between the two arms. A slot 60 in one end of the link provides a lost motion connection between arm 55 and link 59**.

During the initial stage of the cover-opening movement pin 62 on arm 55 slides along slot 60 without transmitting any motion to link 59; cover 36 moves to a partially—open position before rack structure 50 starts its pop-up motion. When the cover reaches an intermediate position **36*a* (FIG. 7) pin 62 is at the forward limit of slot 60; at that point the rack structure 50 begins its pop-up motion. The idea is to delay the pop-up motion until the cover has sufficient clearance (distance) relative to the missiles. FIG. 7 illustrates the rack in its final elevated "pop-up" position. A pin 64 extends from container wall 35 to limit the motion of link 59 and the associated structures 36 and 50. The movement force is provided by springs 34,34,34*a*,34*a***, rather than a manual lift action.

In order to delay the rack pop-up motion, collars **48*a* are adjusted so that springs 34*a* are ineffective by themselves to raise rack structure 50. Springs 34*a* substantially counterbalance the weight of structure 50 (and the missiles) without raising the rack structure. The rack structure is raised by cover 36 (via linkages 55, 59 and 57). Springs 34 and 34*a* share the load comprised of cover 36 and rack structure 50**.

Containers 10 and 12 are mounted on the vehicle so that the cover hinge connections 40 define hinge axes extending parallel to the longitudinal axis of the vehicle. Each cover 36 opens upwardly and outwardly away from the vehicle longitudinal axis.

It will be noted from FIG. 3 that when cover 36 is in its raised (open) position it obstructs a left-to-right line of sight that a potential enemy force might have of the soldier standing in the vehicle hull (during a missile-load operation). Cover 36 at least partially protects the friendly soldier from observation by an enemy force located to the side of the vehicle. The turret 22 protects the soldier from the front, and hatch cover 18 protects the soldier from the rear. There is thus some protection in all four directions.

The missile containers 10 and 12 are located externally of the vehicle such that an enemy hit on either container has a reduced tendency to harm or kill people within the vehicle. The containers are preferably constructed of armor plate material that is resistive to enemy attack. Blowout panels may be provided on the walls of container 10 or 12 to reduce the destructive effects of enemy direct hits by armor piercing projectiles. Antifratracide barriers 32 (FIG. 4) are oriented to be adjacent to the missile propellant chambers (midway along the missile length), such that the barriers tend to shield the propellant from detonation forces.

The primary feature of our invention is the pop-up rack structure 50 and its linkage with cover 36, whereby the missiles are elevated to the level of the missile launch tubes 24. Human effort to effect a missile-load operation is minimized; soldier exposure time to enemy fire is reduced.

Some structural variations are possible while still practicing the invention. For example, the hinges for rack structure 50 need not be spring hinges. The spring hinges associated with cover 36 can be used to raise both the cover and rack structure 50 (since linkage 59 transmits motion from the cover to the rack structure). However, the use of multiple spring hinge structures (on the cover and rack structure) reduces the loadings on the individual springs, thereby giving a better safety factor. The total weight of the cover, rack structure and stored missiles can exceed four hundred pounds; the use of multiple springs is advantageous.

The drawings show a single link 59 at one side of the container (FIG. 4); a duplicate link could be provided at the other side of the container (for better distribution of the load). As shown in FIG. 6, the lost motion slot 60 is located at the outboard end of link 59. The slot could be formed at the other end of the link without changing the overall operational mode.

Figure 8:
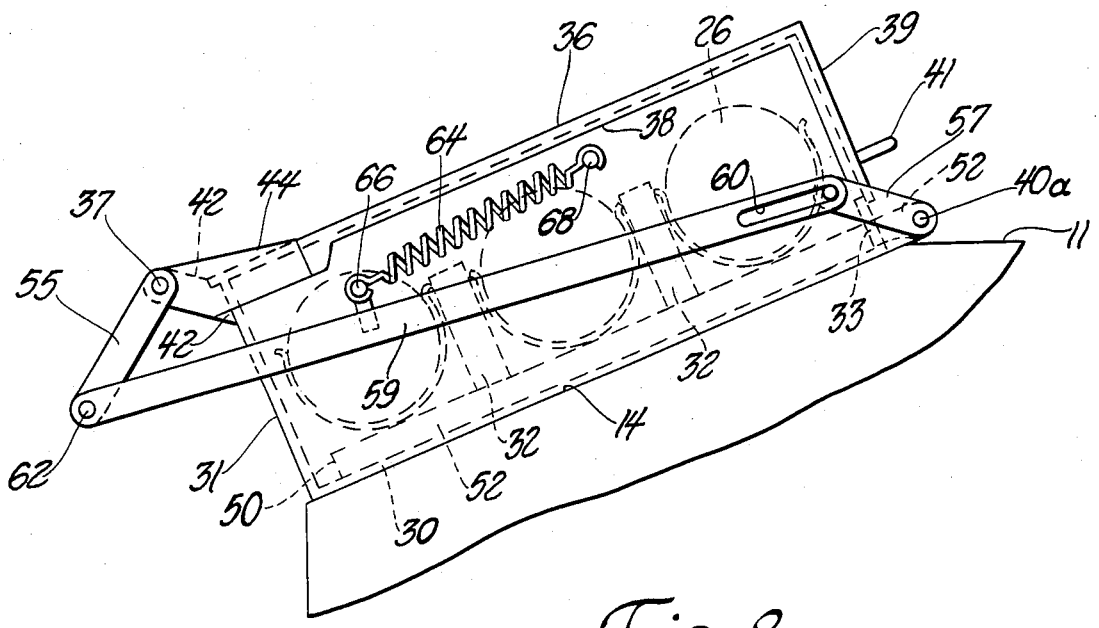
FIG. 8 illustrates a variant of the structure shown in FIG. 6.

FIG. 8 illustrates a slight variant from the FIG. 6 arrangement. In FIG. 8 the lost motion slot 60 is located in the inboard (right) end of link 59. Also, the aforementioned springs 34 and 34*a* (on the hinges) are replaced by a tension spring 64 that is trained between an anchorage 66 on the link and an anchorage 68 on the container side wall. Spring 64 performs the same function as the aforementioned hinge springs 34 and 34*a*.

We wish it to be understood that we do not desire to be limited to the exact details of construction shown and described for obvious modifications will occur to a person skilled in the art, without departing from the spirit and scope of the appended claims.

We claim:

1. In association with a military vehicle that includes a hull having a front end and a rear end, a missile launcher carried externally of the hull forwardly from the hull rear end, and a hatch opening in the hull top wall behind the launcher near the hull rear end: the improvement comprising at least one missile container positioned externally of the hull on the hull top wall outboard from the hatch opening, and a cover for the container; said container being located alongside the hatch opening but behind the missile launcher such that a person can stand in the hull with his upper torso extending through the hatch opening and reach the container without interference from the missile launcher; said cover having a hinged connection with the associated container, whereby the cover has an open position displaced upwardly and outwardly away from the hatch opening; a missile-support rack structure normally located within the container; and means responsive to opening movement of the cover for raising the rack structure out of the container to a position wherein the missiles are located one above another in near adjacency to the hatch opening, whereby a person stationed in the hull can reach out from the hatch opening and remove a missile from the rack structure; said rack structure having missile-engagement means (54) that orients the missiles parallel to the cover hinge axis, whereby a person standing in the hull can manually grip a missile at two spaced points along the missile length.

2. The improvement of claim 1 wherein the rack has a second hinged connection with the container; a spring means incorporated into the first-mentioned hinged connection to bias the cover to an open condition; and means for adjusting the force developed by the spring means on the cover.

3. The improvement of claim 2 wherein the first-mentioned hinged connection is located at the outboard edge of the container, and the second hinged connection is located at the inboard edge of the container.

4. The improvement of claim 3 wherein the means responsive to cover movement comprises a first swingable arm (55) carried by the cover, a second swingable arm (57) carried by the rack structure, and an elongated link interconnecting the two arms.

5. The improvement of claim 1 wherein the hinged connection for the cover is located at the outboard edge of the container; said rack structure having a second hinged connection with the container at the inboard edge of the container whereby the rack structure is swingable upwardly out of the container to an upright position inboard from the container; the means responsive to cover movement comprising a first swingable arm (55) carried by the cover, a second swingable arm (57) carried by the rack structure, and an elongated link interconnecting the two arms.

6. The improvement of claim 5 wherein the elongated link has a lost motion connection with one of the swingable arms.

7. In association with a military vehicle that includes a hull having a front end and a rear end, a turret positioned on the hull forwardly from the hull rear end for rotation in an azimuth plant, a missile launcher carried on the turret, and a hatch opening in the hull top wall behind the turret; the improvement comprising two missile containers positioned externally of the hull on the hull top wall outboard from the hatch opening, and a cover for each container; each container being located alongside the hatch opening but behind the turret such that a person can stand in the hull with his upper torso extending through the hatch opening and reach either container without interference from the turret or missile launcher; each cover having a hinged connection with the associated container; each hinged connection defining a hinge axis extending horizontally on a line paralleling the longitudinal axis of the hull; a missile-support rack structure normally located within each container; and means responsive to opening movement of each cover for raising the associated rack structure out of the associated container, whereby a person stationed in the hull can reach out from the hatch opening and remove a missile from either rack structure; each rack structure having a missile-engagement means that orients the missiles parallel to the cover hinge axis, whereby a person standing in the hull can manually grip a missile at two spaced points along the missile length.

8. The improvement of claim 7 wherein each rack has a second hinged connection with the associated container; each of the first-mentioned hinged connections being located at the outboard edge of the associated container; each second hinged connection being located at the inboard edge of the container; a coiled tension spring means incorporated into each of the first-mentioned hinged connections to bias the associated cover to an open condition; and an adjustment means associated with each spring means for winding or unwinding same to vary the pre-load force developed by said spring means on the associated cover.

9. The improvement of claim 7 wherein the means responsive to cover movement comprises a first swingable arm (55) carried by the cover, a second swingable arm (57) carried by the rack structure, and an elongated link interconnecting the two arms.

10. The improvement of claim 9 wherein the elongated link has a lost motion connection with one of the swingable arms.

* * * * *